US005315357A

United States Patent [19]

Kamijo et al.

[11] Patent Number: 5,315,357

[45] Date of Patent: May 24, 1994

[54] CLEANING UNIT PROVIDED IN XEROGRAPHIC IMAGE FORMING APPARATUS FOR REMOVING RESIDUAL TONER FROM AN IMAGE CARRIER

[75] Inventors: Masahiko Kamijo, Kawasaki; Yozo Matsuura, Machida; Hiroshi Saitoh, Ayase, all of Japan

[73] Assignee: Ricoh Company, Ltd., Tokyo, Japan

[21] Appl. No.: 908,064

[22] Filed: Jul. 6, 1992

[30] Foreign Application Priority Data

Jul. 15, 1991 [JP] Japan ..... 3-174036

[51] Int. Cl.[5] ..... G03G 21/00

[52] U.S. Cl. ..... 355/298; 118/652; 15/256.5; 355/299

[58] Field of Search ..... 355/296, 297, 298, 299; 15/256.51, 256.5; 118/652

[56] References Cited

U.S. PATENT DOCUMENTS

| | | | |
|---|---|---|---|
| 3,660,863 | 5/1972 | Gerbasi | 355/299 |
| 4,314,756 | 2/1982 | Amitani et al. | 15/256.51 X |
| 4,469,434 | 9/1984 | Yamazaki et al. | 355/299 |
| 4,505,577 | 3/1985 | Koizumi | 355/296 X |
| 4,639,123 | 1/1987 | Adachi et al. | 355/299 |
| 4,690,544 | 9/1987 | Forbes, II et al. | 355/299 |
| 4,768,062 | 8/1988 | Tanzawa et al. | 15/256.51 X |
| 4,812,878 | 3/1989 | Kaieda | 355/299 |
| 4,868,607 | 9/1989 | Folkins et al. | 355/296 X |
| 4,875,081 | 10/1989 | Goffe et al. | 355/303 |
| 4,910,560 | 3/1990 | Kanada | 355/299 |
| 4,947,216 | 8/1990 | Surti | 355/299 |
| 5,081,504 | 1/1992 | Morisawa et al. | 355/299 |
| 5,084,739 | 1/1992 | Kalyandurg et al. | 355/299 |
| 5,091,753 | 2/1992 | Slapelis | 355/297 |
| 5,126,798 | 6/1992 | LeRoy et al. | 355/297 |
| 5,138,394 | 8/1992 | Watanabe et al. | 355/298 |
| 5,138,395 | 8/1992 | Lindblad et al. | 355/299 |
| 5,202,735 | 4/1993 | Thayer | 355/298 |
| 5,231,456 | 7/1993 | Kikuchi et al. | 355/270 |

*Primary Examiner*—A. T. Grimley
*Assistant Examiner*—Thu Dang
*Attorney, Agent, or Firm*—Oblon, Spivak, McClelland, Maier & Neustadt

[57] ABSTRACT

A cleaning unit provided in a xerographic image forming apparatus removes residual toner from a photosensitive belt after a transfer process for transferring a developed image from the photosensitive belt to a recording sheet. The cleaning unit includes a cleaning blade for scraping the residual toner from the photosensitive belt, and a housing for storing the residual toner scraped by the cleaning blade. The cleaning blade has a slanting surface formed between a top surface of the cleaning blade and an end of the cleaning blade, the slanting blade slanting from the top surface toward the end of the cleaning blade so as to be inclined at a predetermined angle with respect to the top surface. The developer scraped by the cleaning blade is entered in the housing via the slanting surface and the top surface of the cleaning blade. The cleaning unit further includes a sweeping plate for feeding the residual toner scraped from the photosensitive belt by the cleaning blade into the housing, via a top surface of the cleaning blade.

11 Claims, 8 Drawing Sheets

CLEANING UNIT PROVIDED IN XEROGRAPHIC IMAGE FORMING APPARATUS FOR REMOVING RESIDUAL TONER FROM AN IMAGE CARRIER

BACKGROUND OF THE INVENTION (1) Field of the invention

The present invention generally relates to a cleaning unit provided in a xerographic image forming apparatus applicable to a facsimile machine, a printer, a copy machine and the like, and more particularly to a cleaning unit for removing residual dry developer (i.e. toner) from a photosensitive body in a xerographic machine and for storing the removed residual dry developer.

(2) Description of related art

FIG. 1 shows a xerographic image forming apparatus provided with a conventional cleaning unit. Referring to FIG. 1, a photosensitive belt 1 is wound around rollers 2. The rollers 2 are rotated in a clockwise direction, and thus the photosensitive belt 1 is moved at a predetermined speed in the clockwise direction as shown by an arrow. A discharger unit 3, a charger unit 4, a developing unit 5 having toner T (dry developer), a transfer unit 6 and a cleaning unit 7 are arranged so as to surround the photosensitive belt 1. A xerography process (an electrophotography process) is carried out on the photosensitive belt 1. The cleaning unit 9 has a cleaning blade 8 for removing residual toner from the photosensitive belt 1 and a housing 9 for storing the residual toner removed by the cleaning blade 8. A light beam 11, modulated in accordance with image data, is reflected by a mirror 10 and projected onto the photosensitive belt 1 to an exposure position set immediately after the charger unit 4. The light beam 11 scans the photosensitive belt 1, so that the photosensitive belt 1 is exposed.

The light beam 11 modulated in accordance with the image data scans the photosensitive belt 1 uniformly charged by the charger unit 4, and thus an electrostatic latent image corresponding to the image data is formed on the photosensitive belt 1. The electrostatic latent image is developed by the developer unit 5, so that an image is formed by the toner T on the photosensitive belt 1. The image formed by the toner T is transferred from the photosensitive belt 1 to a recording sheet 2 by the transfer unit 6, so that a toner image is formed on the recording sheet 2. After this, the toner image on the recording sheet 2 is fused and fixed thereon by a fixing unit (not shown).

After a process for transferring the image to the recording sheet 2, a small amount of toner which has not been transferred to the recording sheet 2 remains on the photosensitive belt 1. The residual toner is removed by the cleaning blade 8 from the photosensitive belt 1 along with other residual substances (silicon and other materials). The residual toner removed from the photosensitive belt 1 is stored in the housing 9.

In the conventional cleaning unit 7 described above, an end of the cleaning blade 8 is in contact with the surface of the photosensitive belt 1 as shown in FIG. 2. The cleaning blade 8 is inclined in a direction of the pull of gravity (G) so that the residual toner removed from the photosensitive belt 1 is moved by its own weight along the cleaning blade 8. While the photosensitive belt 1 is being moved, the residual toner T' is scraped from the surface of the photosensitive belt 1 by the cleaning blade 8. The scraped toner T' is accumulated on a region facing on the end of the cleaning blade 8. The scraped toner T' reaching the surface of the cleaning blade 8 continuously moves along the surface of the cleaning blade 8 in a direction indicated by an arrow A. The scraped toner T' that has slidden on the cleaning blade 8 is stored in the housing 9. The toner stored in the housing 9 is fed to the developing unit 5 by a toner recovery system (not shown).

In the conventional cleaning unit, there is no mechanism for leading the scraped toner T' accumulated on the region in front of the cleaning blade 8 to the surface of the cleaning blade 8. Thus, a large amount of toner is accumulated on the region in front of the cleaning blade 8. As a result, it is hard to efficiently feed the scraped toner T' into the housing 9.

SUMMARY OF THE INVENTION

Accordingly, a general object of the present invention is to provide a novel and useful cleaning unit provided in a xerographic image forming apparatus in which the disadvantages of the aforementioned prior art are eliminated.

A more specific object of the present invention is to provide a cleaning unit in which the residual toner scraped from an image carrier medium can be efficiently fed to a housing.

The above objects of the present invention are achieved by a cleaning unit, provided in a xerographic image forming apparatus, for removing residual developer from an image carrier medium after a transfer process for transferring a developed image from the image carrier medium to a recording sheet, the cleaning unit comprising: a cleaning blade, in contact with a surface of the image carrier medium, for scraping the residual developer from the image carrier medium; and a housing for storing the residual toner scraped by the cleaning blade, wherein the cleaning blade has a slanting surface formed between a top surface of the cleaning blade and an end of the cleaning blade, the slanting blade lowering from the top surface toward the end of the cleaning blade so as to be inclined at a predetermined angle with respect to the top surface, and whereby the developer scraped by the cleaning blade is entered into the housing via the slanting surface and the top surface of the cleaning blade.

According to the present invention, as the slanting surface is formed on the cleaning blade, the residual toner scraped from the image carrier medium by the cleaning blade can be efficiently fed into the housing.

The above objects of the present invention are also achieved by a cleaning unit, provided in a xerographic image forming apparatus, for removing residual developer from an image carrier medium after a transfer process for transferring a developed image from the image carrier medium to a recording sheet, the cleaning unit comprising: a cleaning blade, in contact with a surface of the image carrier medium, for scraping the residual developer from the image carrier medium; a housing for storing the residual toner scraped by the cleaning blade; and a sweeping plate for feeding the residual developer scraped by the cleaning blade from the image carrier medium into the housing via a top surface of said cleaning blade.

According to the present invention, as the sweeping plate for feeding the residual developer scraped by the cleaning blade from the image carrier medium into the inside of the housing is provided in the cleaning unit, the residual developer scraped from the image carrier medium can be more efficiently fed into the housing.

Additional objects, features and advantages of the present invention will become apparent from the following detailed description when read in conjunction with the accompanying drawings.

DESCRIPTION OF THE PREFERRED EMBODIMENTS

A description will now be given, with reference to FIGS. 3 through 6, of a cleaning unit according to a first embodiment of the present invention.

Figure 3:
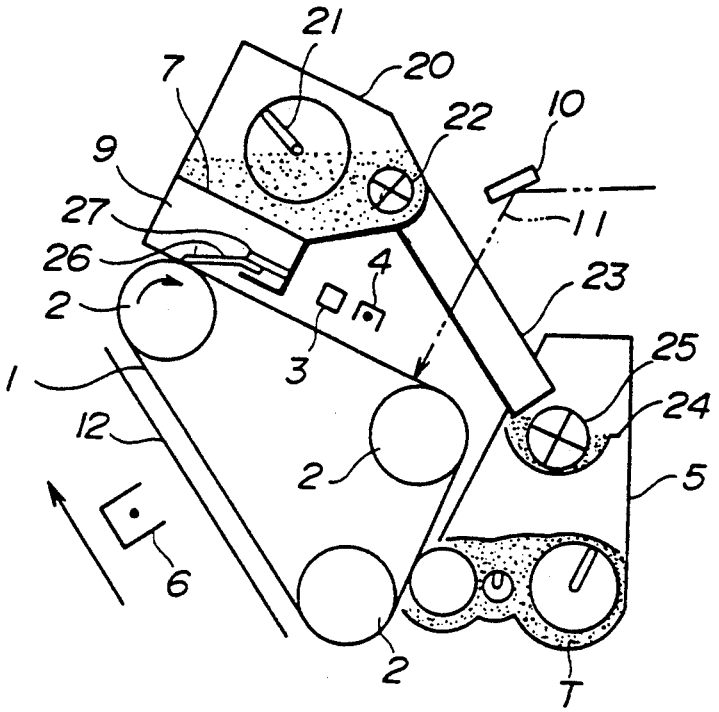
FIG. 3 is a diagram illustrating a xerographic image forming apparatus having a cleaning unit according to a first embodiment of the present invention.

FIG. 3 shows a xerographic copy machine having a cleaning unit according to a first embodiment of the present invention. In FIG. 3, those parts which are the same as parts shown in FIG. 1 are given the same reference numbers.

Figure 1:
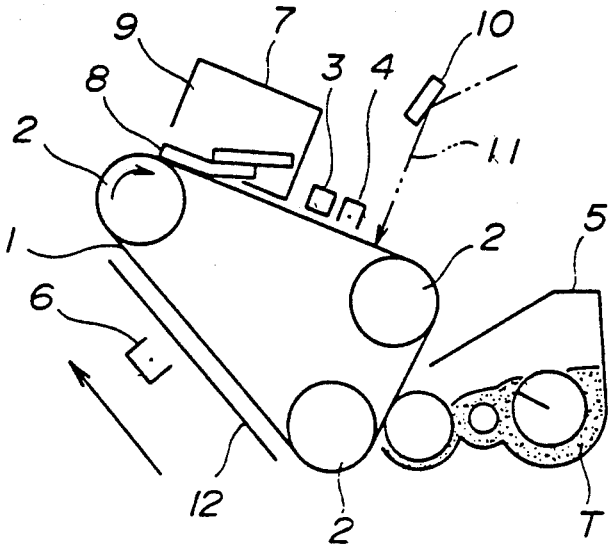
FIG. 1 PRIOR ART
FIG. 1 is a diagram illustrating a xerographic image forming apparatus having a conventional cleaning unit.
Figure 2:
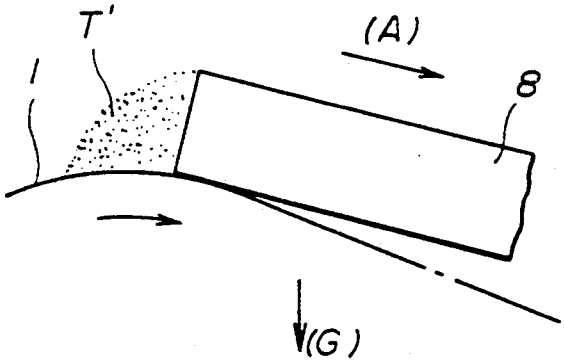
FIG. 2 PRIOR ART
FIG. 2 is an enlarged diagram illustrating a photosensitive belt and a cleaning belt in contact therewith.

Referring to FIG. 3, the xerographic copy unit machine has the photosensitive belt i rotated by the rollers 2, the discharger unit 3, the charger unit 4, the developing unit 5, the transfer unit 6, and the cleaning unit 7, all arranged in the same manner as in FIG. 1. The light beam 11 modulated in accordance with the image data is projected via the mirror 10 onto the photosensitive belt 1 so as to scan it. The xerographic copy machine also has a toner supply unit 20, integrated with the cleaning unit 7, for supplying toner to the developing unit 5. An agitator 21 and a feeding screw 22 are mounted in a housing of the toner supply unit 20, and a duct 23 connects the toner supply unit 20 to the developing unit 5. The toner stored in the housing of the toner supply unit 20 is agitated by the agitator 21, and is supplied by the feeding screw 22 to the developing unit 5 via the duct 23. A U-shaped guide 24 and a toner feeding screw 25 are provided in the developing unit 5.

Figure 4:
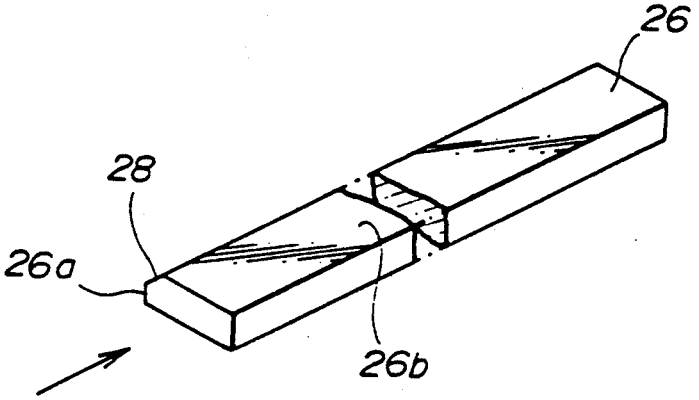
FIG. 4 is a perspective view showing a cleaning blade mounted in the cleaning unit shown in FIG. 3.
Figure 5:
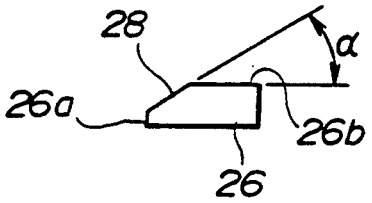
FIG. 5 is a diagram illustrating an end shape of the cleaning blade shown in FIG. 4.

The cleaning unit 7 has the housing 9 and a cleaning blade 26. An end of the cleaning blade 26 is supported by a holder 27 fixed on a wall of the housing 9 so that another end of the cleaning blade 26 is in contact with the surface of the photosensitive belt 1. The cleaning blade 26 is formed as shown in FIGS. 4 and 5. That is, the cleaning blade 26 has an end surface 26*a*, a top surface 26*b*, and a slanting surface 28 between the end surface 26*a* and the top surface 26*b*. The slanting surface 28 inclines toward the end surface 26*a* so as to be inclined at an angle with respect to the top surface 26*b*.

Figure 6:
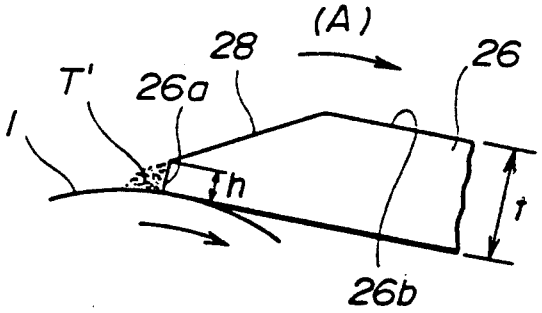
FIG. 6 is an enlarged diagram illustrating a photosensitive belt and the cleaning belt in contact therewith.

The cleaning blade 26 removes the residual toner from the surface of the photosensitive belt 1 as shown in FIG. 6. The end surface 26*a* of the cleaning blade 26 scrapes the residual toner from the surface of the photosensitive belt 1. The scraped toner T' is accumulated on a region in front of the end surface 26*a*. In this case, as the slanting surface 28, inclined so as to slant toward the end surface 26*a*, is formed between the end surface 26*a* and the top surface 26*b*, the height (h) of the end surface 26*a* is smaller than the thickness (t) of the cleaning blade 26. Thus, the amount of the scraped toner accumulated on the region in front of the end surface 26*a* of the cleaning blade 26 is relatively small. The scraped toner T' reaching the slanting surface 28 can be easily lead to the top surface 26*b* via the slanting surface 28. The scraped toner T' lead to the top surface 26*b* is moved thereon toward the housing 9.

The angle of the slanting surface 28 with respect to the top surface 26*b* depends on conditions, such as toner type, a moving speed of the photosensitive belt 1, thickness of the cleaning blade 26, a height of the end surface 26*a* of the cleaning blade 26, and the like.

According to the first embodiment of the present invention, in the cleaning blade 26, the slanting surface 28 is formed between the end surface 26*a* and the top surface 26*b*. Thus, the amount of the scraped toner T' that accumulates on the region front of the end surface 26*a* of the cleaning blade 26 decreases. As a result, the removed toner (the scraped toner) can be efficiently stored in the housing 9 of the cleaning unit 7.

A description will now be given, with reference to FIGS. 7, 8, 9A and 9B, of a second embodiment of the present invention.

Figure 7:
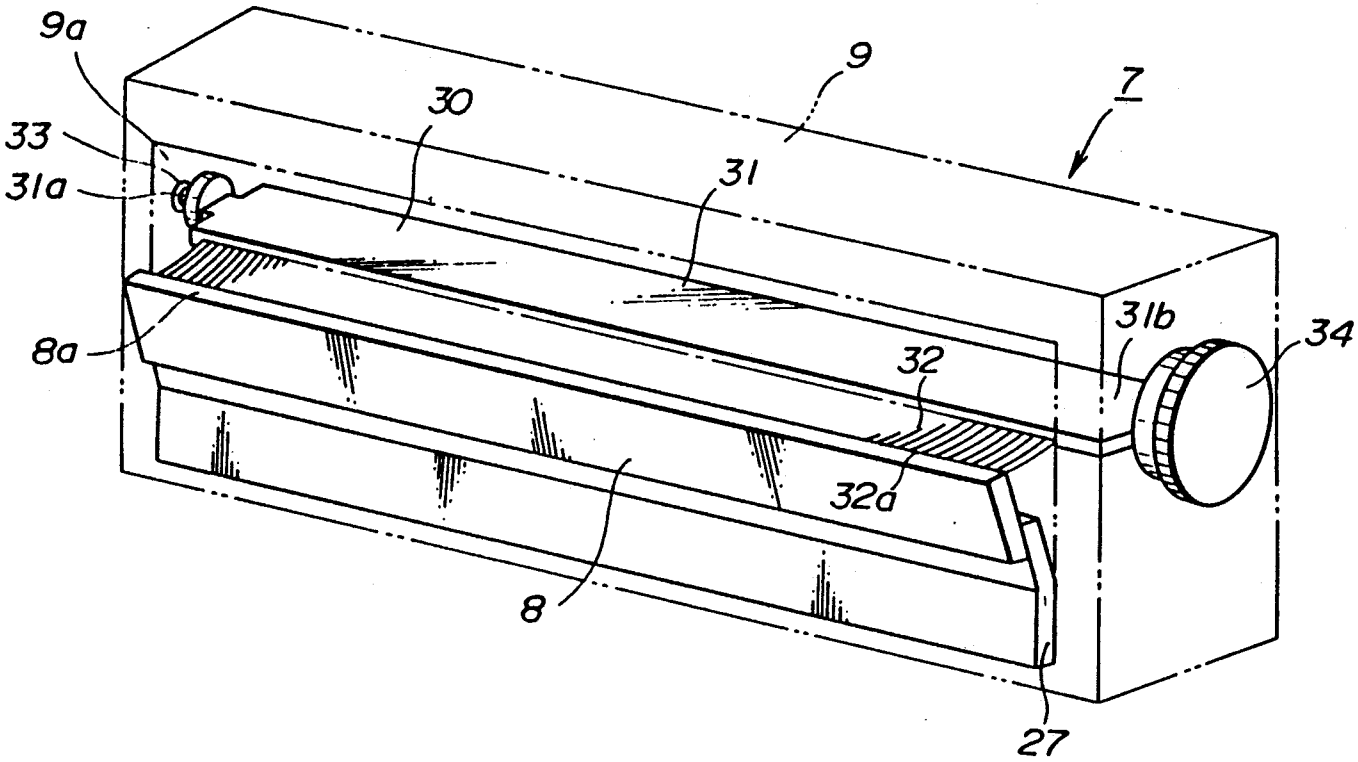
FIG. 7 is a diagram illustrating a cleaning unit according to a second embodiment of the present invention.

FIG. 7 shows a cleaning unit according to the second embodiment of the present invention. Referring to FIG. 7, an end of a cleaning blade 8 is mounted on a holder 27 fixed to the housing 9 so as to be exposed from an opening 9*a* of the housing 9. A sweeping plate 30 is rotatably mounted in the housing 9 of the cleaning unit 7. The sweeping plate 30 has a holder plate 31 and a brush 32 fixed on the holder plate 31. Projection parts 31*a* and 31*b* are respectively formed on ends of the holder plate 31. The projection parts 31*a* and 31*b* of the holder plate 31 are rotatably supported by bearings 33. The projection part 31*b* is coupled to a gear 34 provided outside of the housing 9. The gear 34 is driven by a driving unit (i.e. the motor). An end 32*a* of the brush 32 may be positioned in front of the end surface 8*a* of the cleaning blade 8. The brush 32 may be formed of fine carbon or nylon wires. The number of wires per unit area in the brush 32 depends on conditions such as toner particle size, toner flowability, rotation speed of the brush 32, and the like.

Figure 9A:
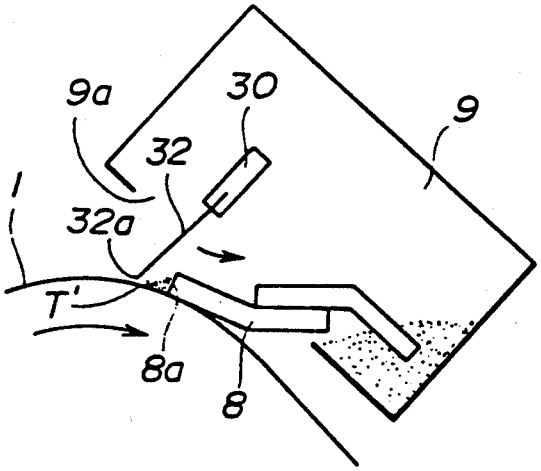
FIGS. 9A and B are diagrams illustrating an operation of the sweeping plate shown in FIGS. 7 and 8.
Figure 9B:
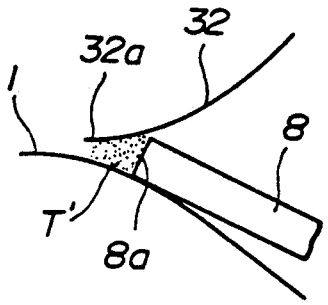

An end 32*a* of the brush 32 reaches a region on which the residual toner scraped from the photosensitive belt I by the cleaning blade 8 is accumulated, as shown in FIG. 9A. While the photosensitive belt 1 is being moved in the xerographic process, the sweeping device 30 is rotated in a counterclockwise direction by the rotation of the gear 34 driven by the driving unit. When the end 32*a* of the brush 32 passes through the region on which the scraped toner T' is accumulated, the brush 32 catches the scraped toner T' bending as shown in FIG. 9B. Then, due to the motion of the brush 32, the scraped toner T' is moved on the surface of the cleaning blade 8. The sweeping plate 30 is further rotated, and the bent brush 32 is restored to its original position. During this time, the scraped toner T' on the surface of the cleaning blade 8 is swept by the brush 32 of the sweeping plate 30 and is fed into the housing 9.

According to the second embodiment, as the sweeping plate 30 sweeps the toner scraped by the cleaning blade 8 and feeds it into the housing 9, the scraped toner can be efficiently stored in the housing 9.

Figure 10:
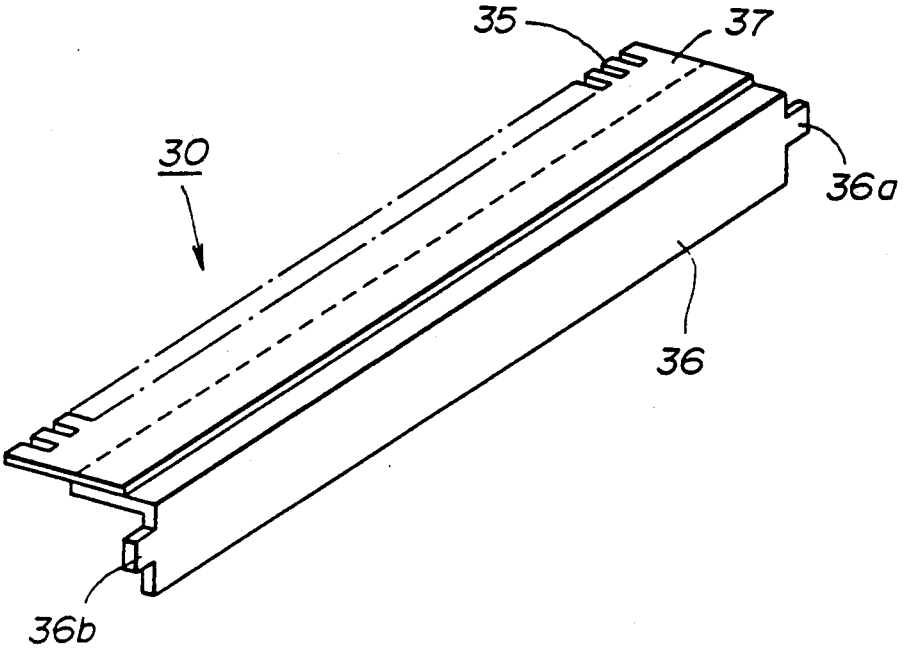
FIG. 10 is a diagram illustrating another sweeping plate capable of being used in the cleaning unit shown in FIG. 7.

The sweeping plate 30 can be also formed as shown in FIG. 10.

Figure 11:
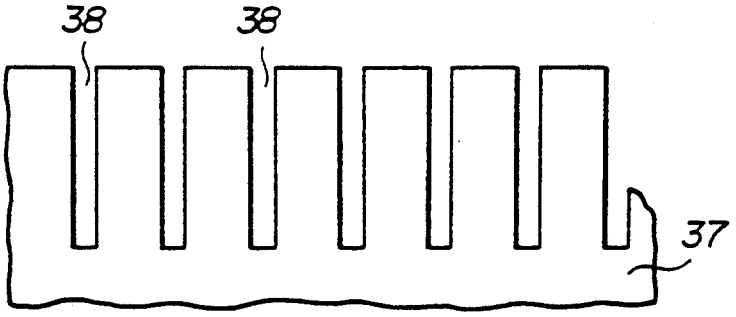
FIG. 11 is a diagram illustrating a structure of a thin film blade used in the sweeping plate shown in FIG. 10.

Referring to FIG. 10, the sweeping plate 30 has a holder plate 36 having an L-shaped side view and a thin film blade 37. Slits 38 are formed at an end of the thin film blade 37 so as to be arranged in a longitudinal direction of the thin film blade 37, as shown in FIG. 11. That is, a comb part 35 is formed at an edge of the thin film blade 37. An end of the thin film blade 37 opposite to the comb part 35 is fixed on the holder plate 36. Projection parts 36*a* and 36*b* are formed at longitudinal ends of the holder plate 36, and of the both projection parts 36*a* and 36*b* are rotatably supported by bearings in the same manner as corresponding parts shown in FIG. 7.

In this case, while the sweeping plate 30 is being rotated, the thin film blade 37 sweeps the scraped toner T' accumulated on the region in front of the cleaning blade 8 and feeds this toner into the housing in the same manner as the brush 32 shown in FIGS. 9A and 9B. As the comb part 35 having the slits 38 is formed at the edge of the thin film blade 37, a load decreases, which load is applied to the driving unit when the comb part 35 of the thin film blade 37 is brought into contact with an inner wall of the housing 9. Thus, the sweep plate can be smoothly rotated and noise can be decreased. The thin film blade 37 can also formed so as to have no comb like slits.

Figure 8:
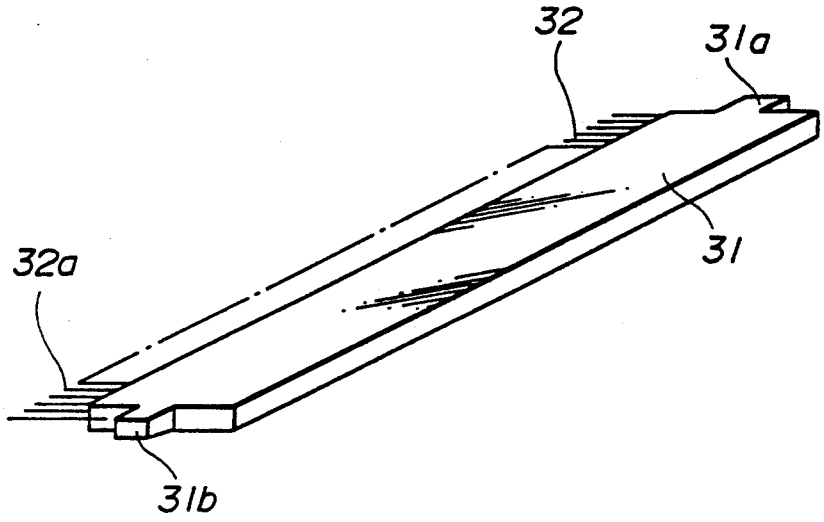
FIG. 8 is a diagram illustrating a sweeping plate provided in the cleaning unit shown in FIG. 7.
Figure 12:
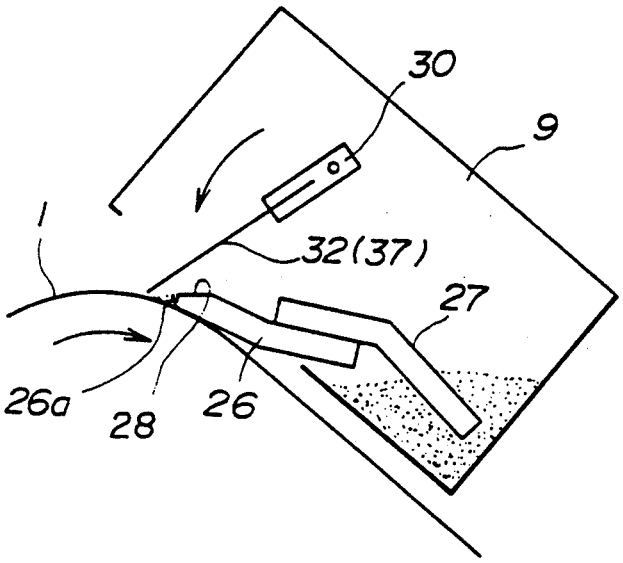
FIG. 12 is a diagram illustrating a cleaning unit according to a third embodiment of the present invention.

FIG. 12 shows a cleaning unit according to a third embodiment of the present invention. In the third embodiment, the slanting surface 28 is formed at the end portion of the cleaning blade 26 in the same manner as that shown in FIGS. 4 and 5 in the first embodiment. The sweeping plate 30 having a structure as shown in FIG. 8 or 10 is rotatably mounted in the housing 9. In the third embodiment, the amount of the scraped toner T' accumulated on the region in front of the cleaning blade 26 decreases, and thus the scraped toner can be more efficiently fed into the housing 9 by the sweeping plate 30.

Figure 13:
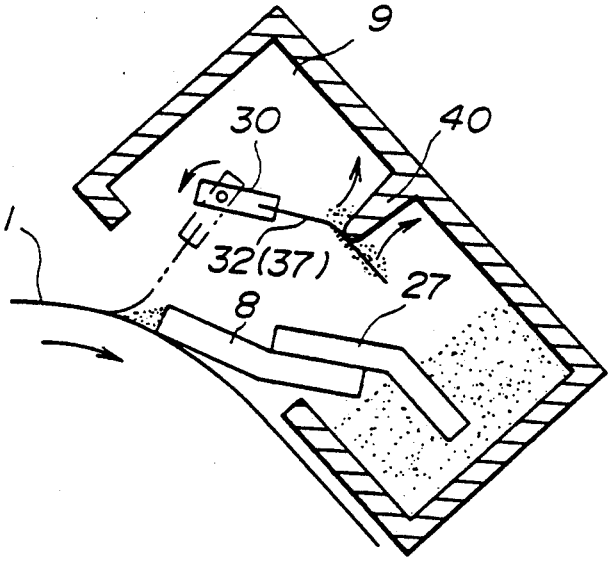
FIG. 13 is a diagram illustrating a cleaning unit according to a fourth embodiment of the present invention.

FIG. 13 shows a cleaning unit according to a fourth embodiment of the present invention. In the fourth embodiment, the sweeping plate 30, and the cleaning blade 8 mounted on the holder 27 are provided in the housing 9 in the same manner as corresponding parts shown in FIG. 7. Further, projection wall 40 is formed on an inside wall of the housing 9 so as to project into a region in which the brush 32 (the thin film blade 37) can be moved. Thus, the brush 32 is periodically brought into contact with the projection wall 40 while the sweeping plate 30 is being rotated. The toner adhered to the brush 32 is scraped therefrom by the projection wall 40 every time the brush 32 is brought into the projection wall 40. According to the fourth embodiment, as the toner adhered to the brush 32 (the thin film blade 37) is automatically scraped therefrom by the projection wall 40, the toner can be efficiently fed into the housing 9 by the sweeping plate 30.

Figure 14:
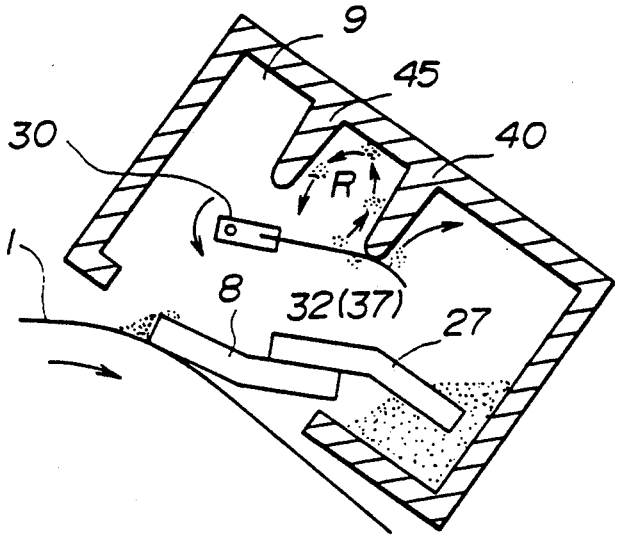
FIG. 14 is a diagram illustrating a cleaning unit according to a fifth embodiment of the present invention.

FIG. 14 shows a cleaning unit according to a fifth embodiment of the present invention. Referring to FIG. 14, the sweeping plate 30 and the cleaning blade 8 mounted on the holder 27 are provided in the housing in the same manner as those shown in FIGS. 7 and 13. Further, two projection walls 40 and 45 are formed on an inside wall of the housing 9 so as to project into a region in which the brush 32 (the thin film blade 37) can be moved. The projection walls 40 and 45 are arranged parallel to each other. Thus, while the sweeping plate 30 is being rotated, the brush 32 is periodically brought into contact with the projection walls 40 and 45 successively. The toner adhered to the brush 32 is scraped therefrom by the projection wall 40 every time the brush 32 is brought into contact with the projection wall 40. Then, the toner scraped from the brush 32 is kept in a space R between the projection walls 40 and 45 until the brush 32 passes through the space R. According to the fifth embodiment, as the toner scraped from the brush 32 is kept in the space R for a while, the toner is prevented from being scattered outside of the housing 9.

Figure 15:
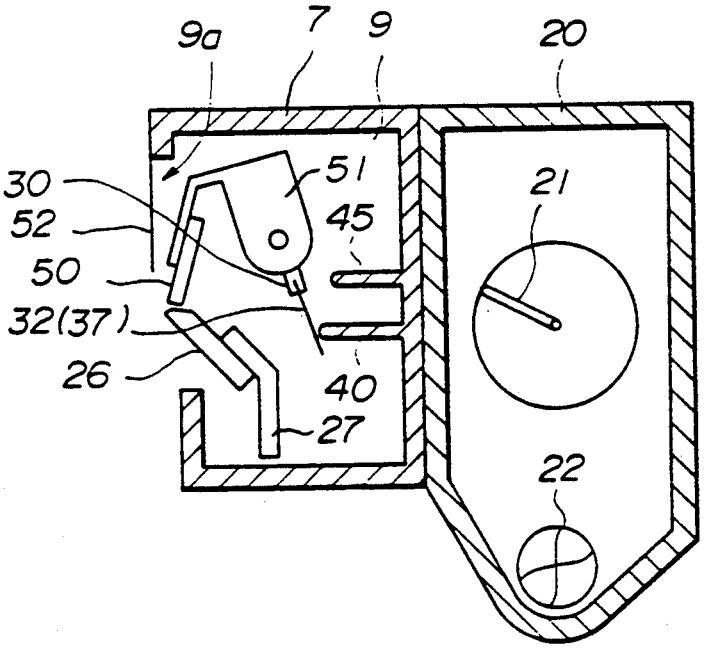
FIG. 15 is a diagram illustrating a cleaning unit according to a sixth embodiment of the present invention.

FIG. 15 shows a cleaning unit according to a sixth embodiment of the present invention. Referring to FIG. 15, the cleaning unit 7 is integrated with the toner supply unit 20 so that a cleaning/toner supplying magazine (CTM) is formed. In the cleaning unit 7, the cleaning blade 26 having a structure as shown in FIGS. 4 and 5, the sweeping plate 30 having a structure as shown in FIG. 8, and the projection walls 40 and 45 arranged as shown in FIG. 14 are provided in the housing 9. Further, a shutter 51 having a magnet 50 is rotatably mounted in the housing 9. The shutter 51 pivots between an open position and a close position at which the magnet 50 faces the end of the cleaning blade 26. A cover 52 is provided on the housing 9 so as to cover the opening 9*a* facing the shutter 51. The toner supply unit 20 is provided with the agitator 21 and feeding screw 22 in the same manner as that shown in FIG. 3.

The present invention is not limited to the aforementioned embodiments, and variations and modifications may be made without departing from the scope of the claimed invention.

What is claimed is:

1. A cleaning unit, provided in a xerographic image forming apparatus, for removing residual developer from an image carrier medium after a transfer process for transferring a developed image from the image carrier medium to a recording sheet, said cleaning unit comprising:

a cleaning blade, in contact with a surface of said image carrier medium, for scraping the residual developer from said image carrier medium;

a housing for storing the residual developer scraped by said cleaning blade; and a sweeping plate for feeding the residual developer, which has been scraped from said image carrier medium by said cleaning blade and has accumulated in front of an end surface of said cleaning blade, so as to lift the residual developer onto a top surface of said cleaning blade, the residual developer swept by said sweeping plate being fed into said housing via the top surface of said cleaning blade.

2. A cleaning unit as claimed in claim 1, wherein said sweeping plate has a brush for sweeping the residual developer scraped from said image carrier medium by said cleaning blade.

3. A cleaning unit as claimed in claim 1, wherein said sweeping plate has a thin film blade for sweeping the residual developer scraped from said image carrier medium by said cleaning blade.

4. A cleaning unit as claimed in claim 3, wherein said thin film blade has slits formed at an end thereof.

5. A cleaning unit as claimed in claim 1, wherein said sweeping plate is rotatable so that the residual developer scraped from said image carrier medium by said cleaning blade is swept and fed by said rotating sweeping plate.

6. A cleaning unit as described in claim 1, wherein said cleaning blade has a slanting surface formed between a top surface of said cleaning blade and an end surface of said cleaning blade, said slanting surface slanting from said top surface toward the end surface of said cleaning blade so as to be inclined at a predetermined angle with respect to the top surface, and the developer scraped by said cleaning blade is entered into said housing via said slanting surface and said top surface of said cleaning blade.

7. A cleaning unit as claimed in claim 5, further comprising means for scraping developer adhered to said sweeping plate while said sweeping plate is being rotated.

8. A cleaning unit as claimed in claim 7, wherein said means for scraping the developer has a projection wall formed on an inside wall of said housing, said projection wall projecting into a region in which said sweeping plate is rotated, so that the developer adhered to said sweeping plate is scraped by said projection wall every time said sweeping plate is brought into said projection wall.

9. A cleaning unit as claimed in claim 7, wherein said means for scraping the developer has a first projection wall and a second projection wall formed on an inside wall of said housing so that a space is formed between the first and second projection walls, said first and second projection walls projecting into a region in which said sweeping plate is rotated, so that the developer adhered to said sweeping plate is scraped by said first projection wall every time said sweeping plate is brought into contact with said first projection wall, and scraped developer is capable of being kept in the space between said first and second projection walls.

10. A cleaning unit as claimed in claim 1, wherein said cleaning unit in integrated with a developer supply unit for supplying developer to a developing unit provided in said xerographic image forming apparatus.

11. A cleaning unit as claimed in claim 1, wherein said sweeping plate is brought into contact with the end surface of said cleaning blade when sweeping the residual developer.

* * * * *